US011045682B1

(12) United States Patent
Hicks et al.

(10) Patent No.: US 11,045,682 B1
(45) Date of Patent: Jun. 29, 2021

(54) WEIGHTED EXERCISE BELT APPARATUS

(71) Applicants: Sharon Hicks, Duncanville, TX (US); Donetta Fulsom, Dallas, TX (US)

(72) Inventors: Sharon Hicks, Duncanville, TX (US); Donetta Fulsom, Dallas, TX (US)

( * ) Notice: Subject to any disclaimer, the term of this patent is extended or adjusted under 35 U.S.C. 154(b) by 44 days.

(21) Appl. No.: 16/728,139

(22) Filed: Dec. 27, 2019

(51) Int. Cl.

| | |
|---|---|
| ***A63B 21/065*** | (2006.01) |
| ***A63B 21/00*** | (2006.01) |
| ***A63B 21/06*** | (2006.01) |
| *A63B 21/005* | (2006.01) |

(52) U.S. Cl.
CPC ..... *A63B 21/065* (2013.01); *A63B 21/06* (2013.01); *A63B 21/4009* (2015.10); *A63B 21/0058* (2013.01)

(58) Field of Classification Search
CPC ..... A63B 21/065; A63B 21/4009; A63B 21/00058; A63B 21/00061; A63B 21/00065; A63B 21/06; A63B 21/4025; A63B 23/02; A63B 23/0205; A63B 23/0233
See application file for complete search history.

(56) References Cited

U.S. PATENT DOCUMENTS

| | | | | |
|---|---|---|---|---|
| 3,659,843 | A | 5/1972 | Kojigian | |
| D279,120 | S | 6/1985 | Spangler | |
| 5,076,575 | A | 12/1991 | Eylander | |
| 5,127,891 | A * | 7/1992 | Winston | A63B 21/065 482/105 |
| 5,501,379 | A * | 3/1996 | Munoz | A41F 9/002 224/240 |
| 5,797,823 | A | 8/1998 | Gouvis | |
| D418,948 | S | 1/2000 | London | |
| 6,200,243 | B1 * | 3/2001 | Meranto | A63B 21/0602 150/150 |
| 6,216,931 | B1 * | 4/2001 | Trawinski | A45F 3/14 224/255 |
| 6,623,419 | B1 | 9/2003 | Smith | |
| 2002/0104151 | A1 * | 8/2002 | Rauscher | A41F 9/002 2/338 |
| 2003/0130070 | A1 * | 7/2003 | Nolan | A63B 21/0605 473/437 |
| 2004/0043875 | A1 * | 3/2004 | Lederfeind | A63B 21/4009 482/105 |
| 2007/0099774 | A1 | 5/2007 | Bruback | |
| 2014/0276307 | A1 | 9/2014 | Landtbom | |

* cited by examiner

*Primary Examiner* — Megan Anderson

(57) ABSTRACT

A weighted exercise belt apparatus for improved fitness and health training includes a belt body extending from a left end to a right end. The left end and the right end have a first and second mating member, respectively. The first and second mating members are selectively engageable to secure the belt body around a user's waist with a medial portion covering the user's lower back. A plurality of primary weight bars is coupled to the belt body. A plurality of magnets is coupled to the medial portion of the belt body. Each of a plurality of pouches has a plurality of first engagement members. The first engagement members are selectively engageable with a plurality of second engagement members of the belt body.

9 Claims, 4 Drawing Sheets

WEIGHTED EXERCISE BELT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to training devices and more particularly pertains to a new training device for improved fitness and health training.

(2) Description of Related Art Including Information Disclosed Under 37 CFR 1.97 and 1.98

The prior art relates to training devices. Existing belts for training and health often incorporate weights or magnets, however rarely offer both. Many weighted belts that offer adjustable weight have permanent sleeves or pockets for weights which remain empty and cumbersome when not in use. Most magnet belts do not offer any access to the magnets and thus the user cannot control the amount of magnetism or size of the magnets.

BRIEF SUMMARY OF THE INVENTION

An embodiment of the disclosure meets the needs presented above by generally comprising a belt body extending from a left end to a right end. The left end and the right end have a first and second mating member, respectively. The first and second mating members are selectively engageable to secure the belt body around a user's waist with a medial portion covering the user's lower back. A plurality of primary weight bars is coupled to the belt body. A plurality of magnets is coupled to the medial portion of the belt body. Each of a plurality of pouches has a plurality of first engagement members. The first engagement members are selectively engageable with a plurality of second engagement members of the belt body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
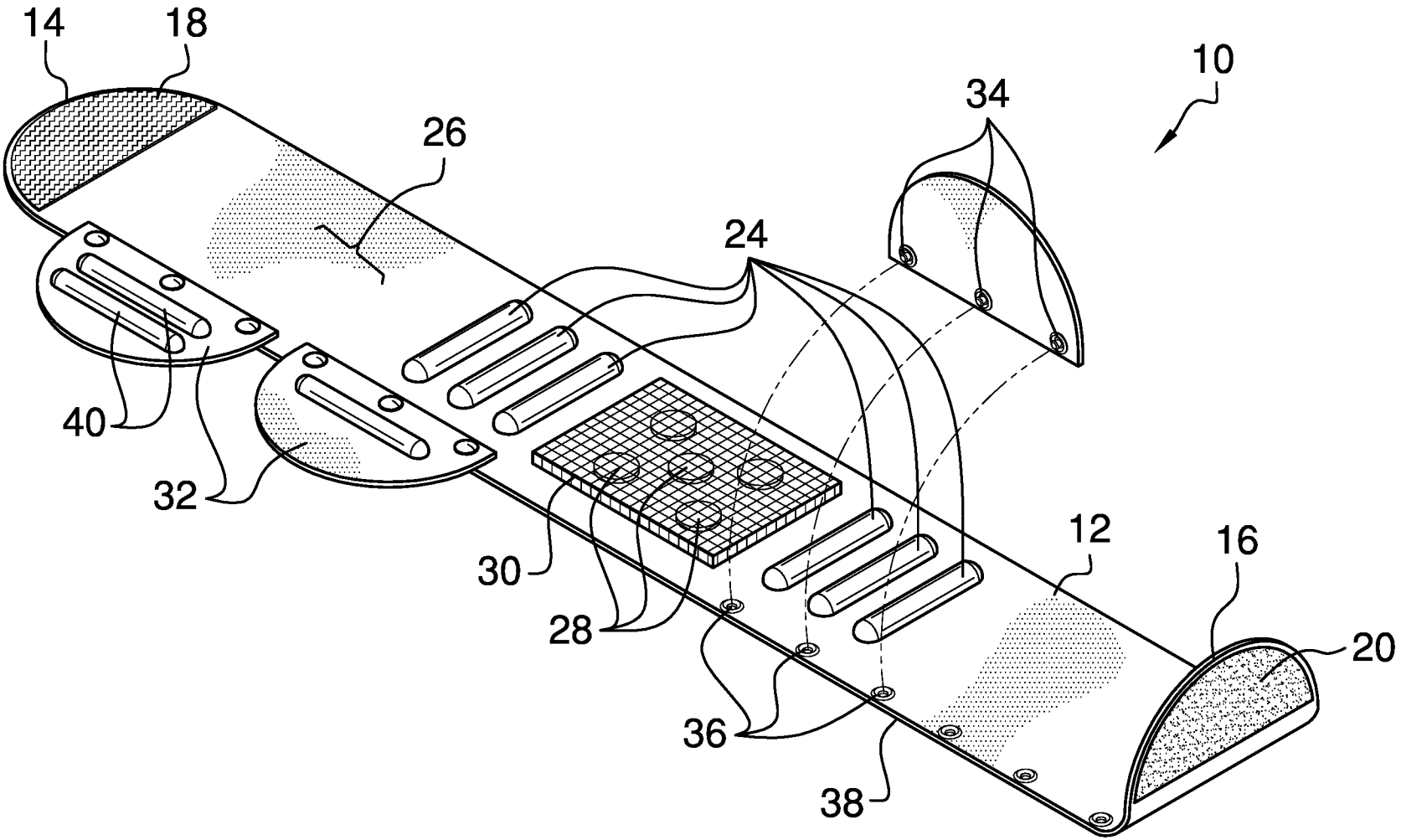
FIG. 1 is an isometric view of a weighted exercise belt apparatus according to an embodiment of the disclosure.
Figure 2:
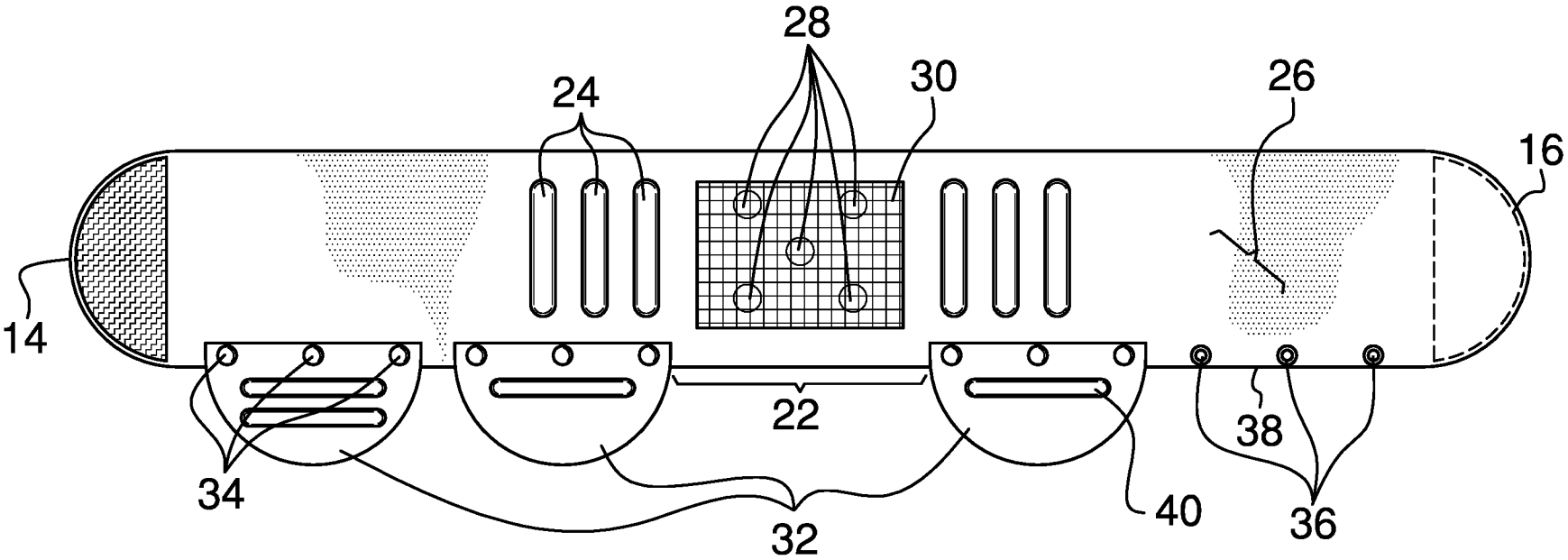
FIG. 2 is a front elevation view of an embodiment of the disclosure.
Figure 3:
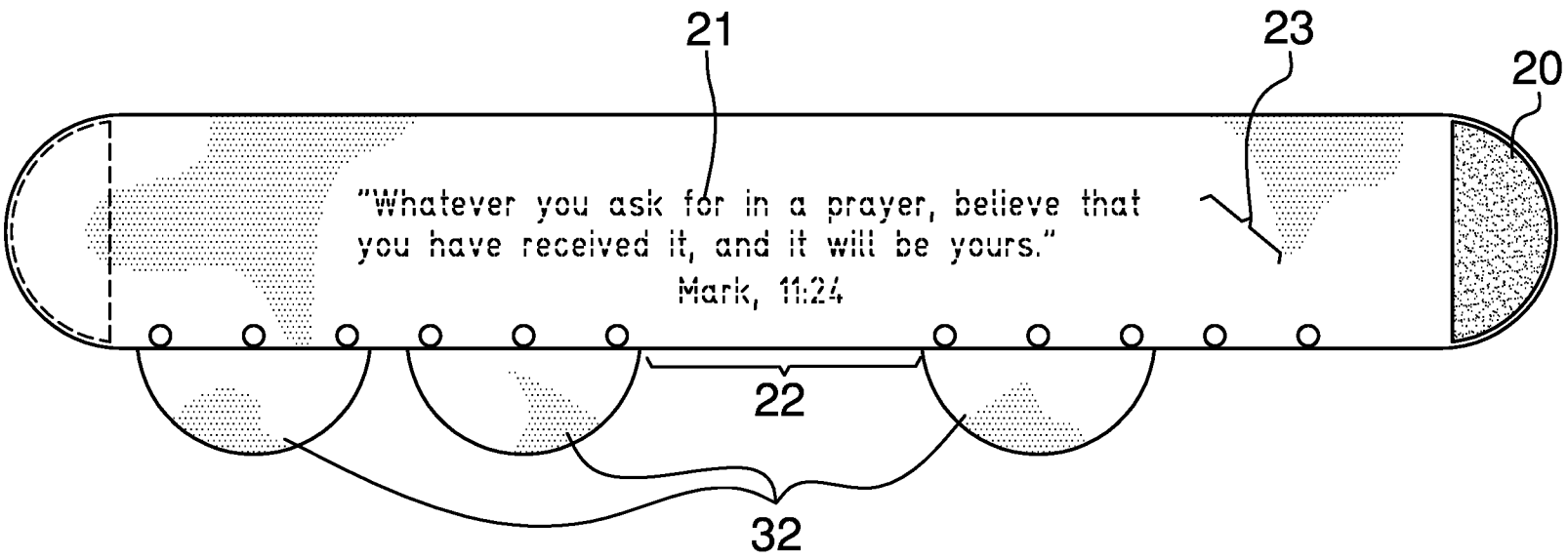
FIG. 3 is a rear elevation view of an embodiment of the disclosure.
Figure 4:
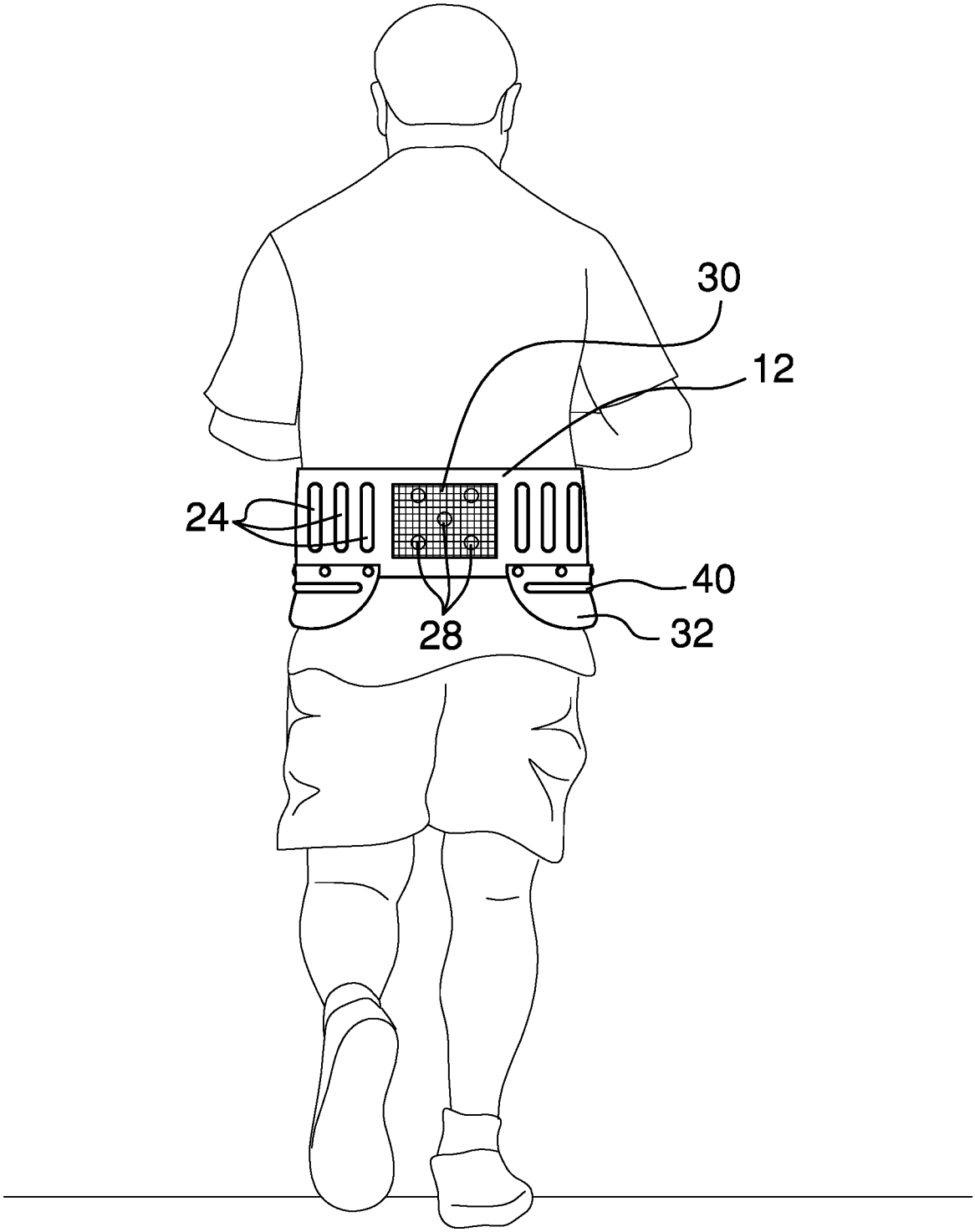
FIG. 4 is an in-use view of an embodiment of the disclosure.

With reference now to the drawings, and in particular to FIGS. 1 through 4 thereof, a new training device embodying the principles and concepts of an embodiment of the disclosure and generally designated by the reference numeral 10 will be described.

As best illustrated in FIGS. 1 through 4, the weighted exercise belt apparatus 10 generally comprises a belt body 12 extending from a left end 14 to a right end 16. The left end 14 and the right end 16 have a first 18 and second mating member 20, respectively. The first 18 and second mating member 20 may be, but are not limited to, hook and loop fasteners, snaps, zippers, or other releasable fasteners. The left end 14 and the right end 16 may be semicircular. The first 18 and second mating member 20 are selectively engageable to secure the belt body 12 around a user's waist with a medial portion 22 covering the user's lower back. The belt body 12 may be neoprene or another semiflexible, waterproof material comfortable to exercise in. A stitched message 21 may be coupled to an inner face 23 of the belt body. The stitched message 21 may be a Bible verse, an inspirational quote, or a motivational phrase to encourage and strengthen the user spiritually and psychologically.

A plurality of primary weight bars 24 is coupled to the belt body 12. The primary weight bars 24 are coupled on each side of the medial portion 22 to create a fixed weight of the apparatus 10. The primary weight bars 24 may be coupled to an outer face 26 of the belt body 12. Each primary weight bar 24 may be a vertically oriented, elongate shape to maintain flexibility of the belt body 12. Each weight bar 24 may be semi-cylindrical with quarter-spherical ends to create an entirely rounded profile for aerodynamics and safety. There may be three primary weight bars 24 on each side of the medial portion 22 but positioned to still rest on the user's back when worn.

A plurality of magnets 28 is coupled to the belt body 12. The plurality of magnets 28 may be coupled within a mesh magnet pocket 30 of the medial portion 22 of the belt body. The mesh magnet pocket 30 is selectively openable to allow the user to remove and add magnets 28 as desired. The magnet pocket 30 may be rectangular and is centrally located on the medial portion 22 to cover and provide pain relief to the user's spine.

Each pouch 32 has a plurality of first engagement members 34. The first engagement members 34 are selectively engageable with a plurality of second engagement members 36 of the belt body. The first 34 and second engagement members 36 may be, but are not limited to, snaps, hook and loop fasteners, or other releasable fasteners. The plurality of second engagement members 36 is evenly distributed between the left end 14 and the medial portion 22 and the right end 16 and the medial portion 22 adjacent a bottom edge 38 of the belt body. Each pouch 32 may have three first engagement members 34 and there may be six second engagement members 36 on each side of the medial portion 22. This allows up to two pouches 32 on each side of the medial portion 22, or for one pouch 32 on each side to be positioned in four different ways. Each pouch 32 has at least one secondary weight bar 40 to incrementally adjust the weight of the apparatus 10. The secondary weight bars 40 are positioned horizontally to minimize interference with the user's movement while exercising. Each pouch 32 may be semicircular to further minimize interference. The pouches 32 may be used to store keys, money, credit cards, electrolyte packs, or other items of convenience to the user.

In use, the left end 14 and the right end 16 are engaged to support the apparatus 10 around the user's waist. Pouches 32 are attached as need to reach the desired weight for the user and for storage. The user may then exercise as normal with increased weight resistance, but also receiving the benefits of the magnets 28 on the lower back and spine.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A weighted exercise belt apparatus comprising:

a belt body extending from a left end to a right end, the left end and the right end having a first and second mating member, respectively, the first and second mating member being selectively engageable to secure the belt body around a user's waist with a medial portion covering the user's lower back;

a plurality of primary weight bars coupled to the belt body;

a plurality of magnets coupled to the medial portion of the belt body; and a plurality of pouches, each of the plurality of pouches having a plurality of first engagement members, the plurality of first engagement members being selectively engageable with a plurality of second engagement members of the belt body.

2. The weighted exercise belt apparatus of claim 1 further comprising the plurality of magnets being coupled within a magnet pocket of the belt body.

3. The weighted exercise belt apparatus of claim 2 further comprising the magnet pocket being mesh.

4. The weighted exercise belt apparatus of claim 1 further comprising each of the plurality of pouches having at least one secondary weight bar.

5. The weighted exercise belt apparatus of claim 1 further comprising each of the right end and the left end being semicircular.

6. The weighted exercise belt apparatus of claim 1 further comprising a stitched message coupled to an inner face of the belt body.

7. The weighted exercise belt apparatus of claim 1 further comprising each of the plurality of pouches being semicircular.

8. The weighted exercise belt apparatus of claim 1 further comprising the plurality of second engagement members being evenly distributed between the left end and the medial portion and the right end and the medial portion adjacent a bottom edge of the belt body.

9. A weighted exercise belt apparatus comprising:

a belt body extending from a left end to a right end, each of the left end and the right end being semicircular and having a first and second mating member, respectively, the first and second mating member being selectively engageable to secure the belt body around a user's waist with a medial portion covering the user's lower back;

a plurality of primary weight bars coupled to the belt body;

a plurality of magnets coupled to the belt body, the plurality of magnets being coupled within a mesh magnet pocket of the medial portion of the belt body;

a stitched message coupled to an inner face of the belt body; and a plurality of pouches, each of the plurality of pouches having a plurality of first engagement members, the plurality of first engagement members being selectively engageable with a plurality of second engagement members of the belt body, the plurality of second engagement members being evenly distributed between the left end and the medial portion and the right end and the medial portion adjacent a bottom edge of the belt body, each of the plurality of pouches having at least one secondary weight bar, each of the plurality of pouches being semicircular.

* * * * *